US005937957A

United States Patent [19]

Swietlik

[11] Patent Number: 5,937,957

[45] Date of Patent: Aug. 17, 1999

[54] CUTTING BED IMPELLER

[76] Inventor: George Swietlik, The Sandings, Broadview Road, Oulton Broad, Lowestoft, NR32 3PL, United Kingdom

[21] Appl. No.: 08/877,881

[22] Filed: Jun. 18, 1997

[30] Foreign Application Priority Data

Jun. 18, 1996 [GB] United Kingdom ..... 9612702

[51] Int. Cl.[6] ..... E21B 10/44

[52] U.S. Cl. ..... 175/323; 175/324; 175/325.4; 166/173

[58] Field of Search ..... 166/173; 175/323, 175/325.1, 325.2, 325.3, 325.4, 324

[56] References Cited

U.S. PATENT DOCUMENTS

| | | | |
|---|---|---|---|
| 3,268,274 | 8/1966 | Ortloff et al. | 175/325.4 |
| 3,285,678 | 11/1966 | Garrett et al. | 175/325.2 |
| 3,420,323 | 1/1969 | Owens | 175/323 |
| 4,277,869 | 7/1981 | Hartwell | 175/325.4 X |
| 4,384,626 | 5/1983 | Derouin | 175/325.4 X |
| 4,479,538 | 10/1984 | Coyle, Sr. | 166/173 |
| 4,489,793 | 12/1984 | Boren | 175/324 X |
| 4,540,055 | 9/1985 | Drummond et al. | 175/324 X |
| 4,757,861 | 7/1988 | Klyne | 175/323 X |
| 4,811,800 | 3/1989 | Hill et al. | 175/323 |
| 4,854,399 | 8/1989 | Zijsling . | |
| 5,040,620 | 8/1991 | Nunley . | |
| 5,570,742 | 11/1996 | Reynolds et al. | 166/173 |

FOREIGN PATENT DOCUMENTS

| | | |
|---|---|---|
| 2047775 | 12/1980 | United Kingdom . |
| 2061358 | 5/1981 | United Kingdom . |
| 2133059 | 7/1984 | United Kingdom . |

*Primary Examiner*—Tamara Graysay
*Assistant Examiner*—Jong-Suk Lee
*Attorney, Agent, or Firm*—Emrich & Dithmar

[57] ABSTRACT

A cutting bed impeller (10) comprises a body portion and a plurality of paddles (24) projecting from the body portion, one or more of the paddles (24) having a recess (18) on its leading face in the direction of rotation of the impeller (10). The radially outer face (26) of one or more of the paddles (24) may be provided with one or more replaceable wear elements (30, 38). For example the elements may comprise nylon inserts (30) fitted into openings (28) in the radially outer faces (26) of the paddles (24).

15 Claims, 2 Drawing Sheets

CUTTING BED IMPELLER

BACKGROUND OF THE INVENTION

1. Field of the Invention

This invention relates to equipment for drilling operations.

1. Description of the Prior Art

In conventional drilling operations, mud or other drilling fluid is pumped down a hollow bore in the drill string and is ejected from the drill bit to lift the drill cuttings out of the bore-hole.

In an inclined well-bore it is been found that at a certain deviation or sail angle, some of the drill cuttings being transported back to the surface by the drilling fluid fall out of the main flow and settle on the lower portion of the bore-hole. These cuttings interfere with the drilling process and especially with the rotation of the rotating drill-pipe which also lies on the low side of the bore-hole.

The flow of returning drilling fluid which carries the cuttings is not uniform across the diameter of the bore-hole. On the low side of the bore-hole the flow is at a minimum and the capacity of the drilling fluid to transport drilling cuttings and solid particles is reduced.

To overcome this problem it is known to fit one or more cutting bed impellers to the drill-pipe. The impellers are integrally formed with a length of drill-pipe and comprise a body portion having a central longitudinal bore and a plurality of paddles in the form of single spiral blades which project radially outwardly from the body portion. These types of blade are similar in profile to those used on down-hole drilling stabilizers.

As the cutting bed impeller rotates with the drill-pipe, it disturbs and agitates the settled cuttings and other particles and moves them upwards into the path of the main flow of cutting fluid on the upper side of the bore-hole. Although these tools have proved reasonably effective they have been found to create extra down-hole torque.

SUMMARY OF THE INVENTION

According to the present invention there is provided a cutting bed impeller comprising a body portion and a plurality of paddles projecting from the body portion, one or more of the paddles having a recess on its leading face in the direction of rotation of the impeller.

Each paddle is preferably substantially V-shaped; the recess comprising the area enclosed by the sides of the vee. Preferably the sides of the vee are inclined at an angle of between 10° to 50°. Most preferably, the sides of the vee are inclined at an angle of approximately 30° to the longitudinal axis of the drill-pipe and may comprise a left hand partial spiral connected to a right hand partial spiral.

In an alternative embodiment, the paddles are straight; the recess in each paddle comprising a depression formed in the leading face of the paddle.

The or each recess is preferably between ¼" to 2" (6.4 to 51 mm) deep.

Preferably the cutting bed impeller comprises part of a drill string sub, rather than a complete length of drill-pipe. Preferably the wall thickness of the sub is reduced on one or both sides of the cutting bed impeller. This reduced thickness portion accommodates bending due to high side forces which may be generated on the sub.

The provision of the cutting bed impeller on a sub allows the tool to be run in conjunction with or immediately between bearing devices or torque reduction tools. This is not possible with a conventional cutting bed impeller, which is integrally formed with a length of drill-pipe.

The radially outer face of one or more of the paddles may be provided with replaceable wear elements. These wear elements may comprise nylon inserts fitted into openings in the radially outer faces of the paddles. The nylon inserts may be cylindrical and may fit within blind bores in the paddles. In another embodiment, the wear elements comprise wear pads which fit within slots formed through the paddles. Alternatively, the replaceable wear elements may comprise any appropriate shape or size of element or elements which may be used to protect the cutting bed impeller from abrasion with the wall of the bore-hole and/or which reduce the down-hole torque.

Preferably the wear elements comprise approximately 60% of the total area of the radially outer surface of the or each paddle.

The recess on each paddle acts as a scoop to lift cuttings and solid particles from the lower portion of the bore-hole into the main flow of cutting fluid in the upper portion of the bore-hole. The effectiveness of the impeller is governed by the size of the clearance between the radially outer faces of the paddles and the bore-hole wall, the included angle of the sides of the vee of the recess and the profile of the recess.

According to another aspect of the present invention there is provided a cutting bed impeller comprising a body portion and a plurality of paddles projecting from the body portion, replaceable wear elements being provided on the radially outer faces of one or more of the paddles.

Preferably, replaceable wear elements are disposed equidistantly around the circumference of the impeller to ensure an even bearing in the bore-hole. For example, they may be provided on oppositely disposed pairs of paddles. A plurality of cutting bed impellers may be fitted to a drill string. The cutting bed impellers are preferably spaced apart at 90 m to 150 m (300 ft to 500 ft) intervals.

BRIEF DESCRIPTION OF THE DRAWINGS

For a better understanding of the present invention, and to show how it may be carried into effect, reference will now be made, by way of example, to the accompanying drawings, in which.

DESCRIPTION OF THE PREFERRED EMBODIMENTS

Figure 1:
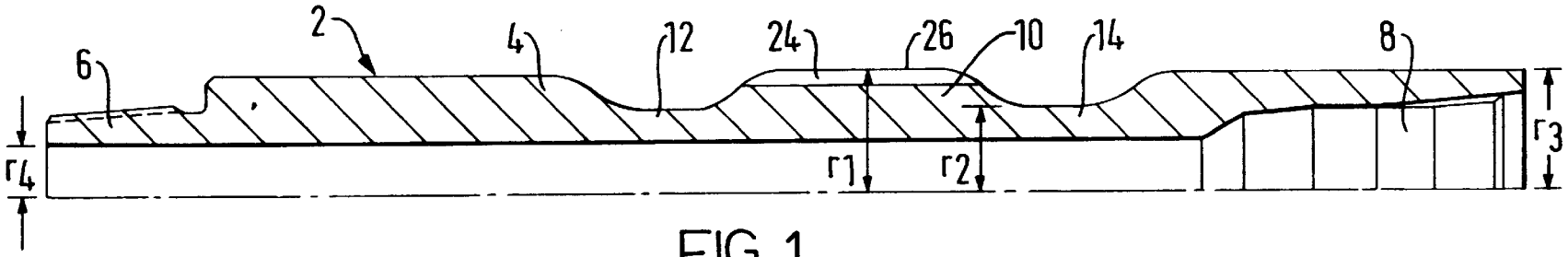
FIG. 1 is a longitudinal partial-cross section through a drill string sub.

Referring to the drawings, FIG. 1 shows a drill string sub 2 comprising a hollow cylindrical sleeve 4 having a male connector or pin 6 at one end and a female connector or box 8 at the other end. A cutting bed impeller 10 is integrally formed with the sleeve 4 at an intermediate point along its length. On either side of the cutting bed impeller 10, the sleeve 4 has a reduced external diameter which provides bending zones 12, 14 which enable the drill string sub to accommodate the reverse bending forces which are generated as the sub 2 rotates in the curve of a deviated borehole.

Figure 3:
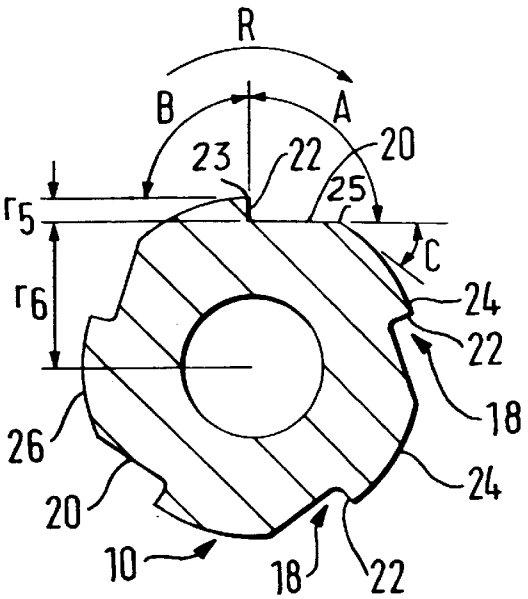
FIG. 3 is an axial cross-section on line III—III in FIG. 2.
Figure 2:
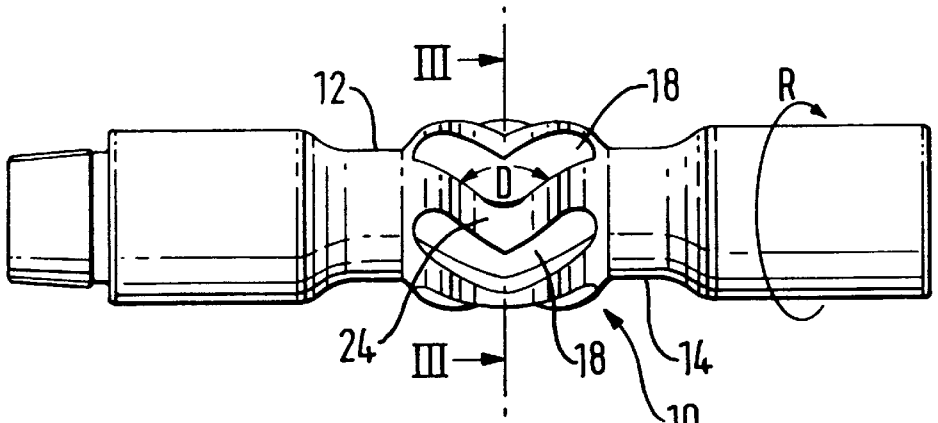
FIG. 2 is a side view of a drill-string sub.

As best shown in FIGS. 2 and 3, the cutting bed impeller 10 comprises a substantially cylindrical body portion into which are machined five substantially V-shaped grooves 18. Each groove 18 comprises a tangential bottom wall 20 and a radially disposed V-shaped wall 22. The angle D between the V-shaped sides of the wall 22 is preferably approximately 120°.

Between respective pairs of grooves 18 are defined respective V-shaped paddles 24 having a radially outer face 26 which is received with some play in the bore-hole. The V-shaped wall 22 which is substantially flat when viewed, as seen in FIG. 3, in axial cross-section, forms a leading face of a paddle 24 and the tangential bottom wall 20 forms a trailing face of the paddle 24. The angle A between the V-shaped wall 22 and the tangential bottom wall 20 is preferably between 60° and 120° and the angle B between the V-shaped wall 22 and tangent to the outer face 26 at the leading edge 23 of the paddle 24 is preferably between 60° to 120°. The angle C between the tangential bottom wall 20 and a tangent to the outer face 26 at the trailing edge 25 of the paddle 24 should always be less than the angle B and is preferably between 20° and 40° . Thus, the V-shaped wall 22 presents a sharp leading edge and 23 the recesses 18 are asymmetrical when viewed in cross-section.

Figure 4:
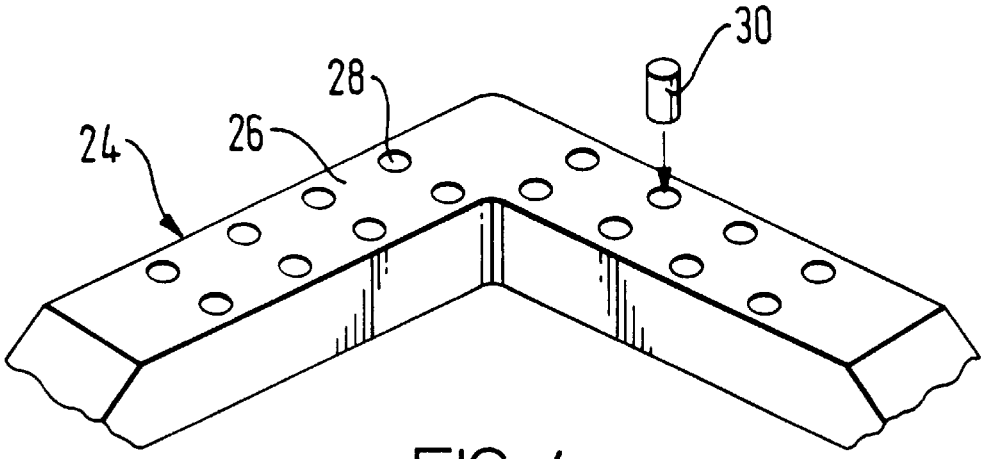
FIG. 4 is an enlarged view of a paddle having cylindrical replaceable wear elements.

FIG. 4 shows another embodiment of paddle 24 which is provided with a plurality of blind bores 28. Respective cylindrical replaceable wear elements 30 are located in each bore 28, such that they project slightly from the radially outer face 26 of the paddles 24. The wear elements 30 provide a replaceable bearing surface which protects the cutting bed impeller 10 from abrasion against the wall of the bore-hole and reduces down-hole torque.

Figure 5:
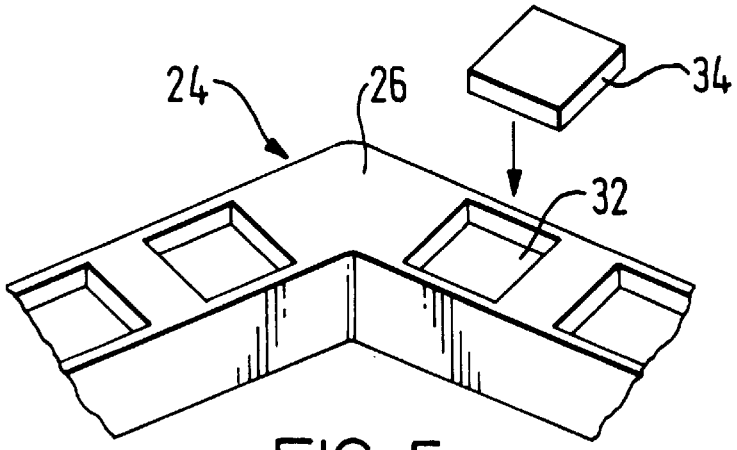
FIG. 5 shows an alternative form of paddle having rectangular replaceable wear elements.

FIG. 5 shows another embodiment of the paddle 24 which is provided with cut outs 32 in which are located square replaceable wear elements 34.

Figure 6:
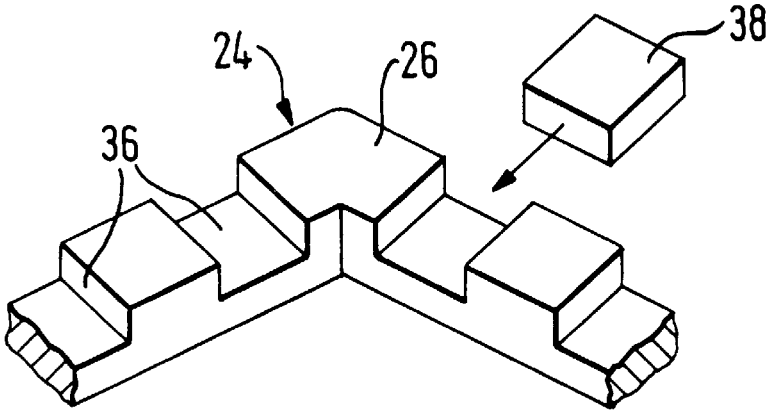
FIG. 6 shows an alternative embodiment of paddle using square replaceable wear elements.

FIG. 6 shows a final embodiment of paddle 24 in which are machined transverse slots 36. Rectangular replaceable wear elements 38 are located in the slots and are held in place by adhesive, by screws or by any other appropriate fixing means.

The replaceable wear elements 30, 34, 38 are preferably made of nylon but any other appropriate material may be used and any shape of wear element is contemplated.

In use, the drill string sub 2 is fitted to a drill pipe and is rotated in a direction indicated by an arrow R in FIG. 3, as drilling proceeds. Drilling fluid is pumped down the hollow interior of the drill-pipe and is ejected at the drill bit to force cuttings and other solid particles up and out of the bore-hole.

As the cutting bed impeller 10 rotates, cuttings and other solid particles lying on the lower portion of the bore-hole are caught against the radially disposed walls 22 of the grooves 18 and are scooped upwards into the main flow of drilling fluid where they become entrained in the flow. The zones 12, 14 act as clearance areas for the turbulence created by the paddles 24 in lifting the debris to the high side of the hole. Consequently, the borehole is kept cleaner with less debris accumulating on the low side of the hole, so that there is less sliding friction when picking up or lowering the drill string.

The combination of the V-shaping of the paddles 24 and the asymmetrical cross-section of the recess 18 result in a very efficient blade profile which enhances the scooping/pumping action of the impeller.

In the illustrated embodiments, the paddles 24 are defined between respective pairs of grooves 18 and the recesses which scoop up the cuttings and other solid particles are defined between the bottom wall 20 and radially disposed wall 22 of respective grooves 18. However it is contemplated that these recesses could comprise depressions formed in the leading face of each paddle 24 and consequently the scooping action characteristic of the present invention could be achieved using a straight paddle or a paddle which has only a single directional spiral, provided a suitable depression is formed in the leading face of the paddle 24.

If the paddles 24 are provided with replaceable wear elements, which can be renewed periodically, the service life of the cutting bed impeller 10 is greatly increased. Furthermore, the replaceable wear elements reduce the drag on the walls of the bore-hole, thereby reducing the down-hole torque.

If the cutting bed impeller 10 is carried on a short drill-string sub it can be run in conjunction with or immediately between bearing devices or torque reduction tools, so that a further reduction in downhole torque is possible. It is however contemplated that the cutting bed impeller 10 could also be formed on a length of drill-pipe, particularly as the provision of replaceable wear elements provides a torque reduction function.

In an embodiment of the invention which has been found to work successfully, the dimensions shown in the drawings are as follows:

$r^1$=3.838"

$r^2$=2.653"

$r^3$=3.688"

$r^4$=1.625"

$r^5$=0.502"

$r^6$=3.335"

A=90°

D=120°

I claim:

1. A cutting bed impeller comprising:

a body portion; and a plurality of paddles projecting from the body portion; at least one of the paddles being substantially V-shaped and having an arcuate outer face extending between a leading edge and a trailing edge relative to the operative direction of rotation, a leading face which is substantially flat when viewed in an axial cross section of the impeller, and a trailing face which is substantially flat when viewed in the axial cross section of the impeller, the leading face being inclined at a first angle to a first tangent to the outer face at the leading edge, the trailing face being inclined at a second angle to a second tangent to the outer face at the trailing edge, the second angle being less than the first angle.

2. The cutting bed impeller as claimed in claim 1, in which the body portion has a recess at the leading face of the at least one paddle.

3. The cutting bed impeller as claimed in claim 2, in which the recess comprises a depression formed between the leading face of the paddle and an adjacent paddle.

4. The cutting bed impeller as claimed in claim 1, wherein the cutting bed impeller is coupled to a drill-pipe and each V-shaped paddle has first and second sides inclined at an angle of approximately 30° to the longitudinal axis of the drill-pipe.

5. The cutting bed impeller as claimed in claim 4, in which the first and second sides are in the form of a left-hand partial spiral connected to a right-hand partial spiral.

6. The cutting bed impeller as claimed in any one of the preceding claims, comprising part of a drill string sub.

7. The cutting bed impeller as claimed in claim 6, in which the drill string sub has a wall thickness reduced on one or both sides of the cutting bed impeller.

8. The cutting bed impeller as claimed in claim 1, in which the arcuate outer face of the at least one paddle is provided with a replaceable wear element.

9. The cutting bed impeller as claimed in claim 8, in which the wear element comprises a nylon insert fitted into an opening in the arcuate outer face of the paddle.

10. The cutting bed impeller as claimed in claim 9, in which the nylon insert is cylindrical and is fitted within a blind bore in the paddle.

11. The cutting bed impeller as claimed in claim 9, in which the wear element is received within a slot formed through the paddle.

12. The cutting bed impeller as claimed in claim 1, wherein more than one of the paddles include at least one replaceable wear element, the paddles provided with the at least one replaceable wear element being disposed equidistantly around the circumference of the cutting bed impeller.

13. The cutting bed impeller as claimed in claim 1, wherein oppositely disposed pairs of the paddles are provided with at least one replaceable wear element.

14. The cutting bed impeller as claimed in claim 1, wherein each paddle is substantially V-shaped and has an arcuate outer face extending between a leading edge and a trailing edge relative to the operative direction of rotation, a leading face which is substantially flat when viewed in an axial cross section of the impeller, and a trailing face which is substantially flat when viewed in the axial cross section of the impeller, the leading face being inclined at a first angle to a first tangent to the outer face at the leading edge, the trailing face being inclined at a second angle to a second tangent to the outer face at the trailing edge, the second angle being less than the first angle.

15. The cutting bed impeller as claimed in claim 14, wherein each leading face cooperates with a trailing face of an adjacent paddle to define a recess.

* * * * *